US008844764B2

(12) United States Patent
Curtin et al.

(10) Patent No.: US 8,844,764 B2
(45) Date of Patent: Sep. 30, 2014

(54) BAKED GOODS CARRIER

(75) Inventors: Heather Curtin, Duarte, CA (US); Christine J. Lee, Seattle, WA (US); Caroline Park, Seattle, WA (US)

(73) Assignee: Progressive International Corporation, Kent, WA (US)

( * ) Notice: Subject to any disclaimer, the term of this patent is extended or adjusted under 35 U.S.C. 154(b) by 304 days.

(21) Appl. No.: 12/703,138

(22) Filed: Feb. 9, 2010

(65) Prior Publication Data

US 2010/0200583 A1 Aug. 12, 2010

Related U.S. Application Data

(60) Provisional application No. 61/151,802, filed on Feb. 11, 2009.

(51) Int. Cl.

| | |
|---|---|
| ***B65D 6/16*** | (2006.01) |
| ***B65D 85/36*** | (2006.01) |
| ***B65D 43/02*** | (2006.01) |
| *B65D 1/36* | (2006.01) |

(52) U.S. Cl.

CPC .. *B65D 43/0206* (2013.01); *B65D 2543/00296* (2013.01); *B65D 85/36* (2013.01); *B65D 2543/00453* (2013.01); *B65D 2543/00092* (2013.01); *B65D 2543/00222* (2013.01); *B65D 2543/0037* (2013.01); *B65D 2543/00361* (2013.01)

USPC ..... 220/836; 220/6; 220/23.86; 220/507; 220/666

(58) Field of Classification Search

USPC ..... 220/836, 4.27, 4.28, 6, 315, 507, 720, 220/666, 23.86; 206/562

See application file for complete search history.

(56) References Cited

U.S. PATENT DOCUMENTS

| | | | | |
|---|---|---|---|---|
| 2,725,087 | A | | 11/1955 | Potter |
| 3,306,311 | A | * | 2/1967 | Buerger ..... 220/6 |
| 3,347,060 | A | | 10/1967 | Barkan |
| D235,406 | S | | 6/1975 | Daenen |
| 3,981,401 | A | | 9/1976 | Blanchard |
| 4,157,103 | A | | 6/1979 | La Fleur |
| 4,705,172 | A | | 11/1987 | Gage |
| D348,378 | S | * | 7/1994 | Crane ..... D7/610 |
| 5,377,860 | A | | 1/1995 | Littlejohn et al. |
| D357,161 | S | | 4/1995 | Booten |
| 5,415,309 | A | | 5/1995 | Wang |
| 5,542,560 | A | * | 8/1996 | Gerster et al. ..... 220/252 |
| D373,954 | S | | 9/1996 | Wolff |
| 5,632,406 | A | * | 5/1997 | Robbins, III ..... 220/666 |
| 5,701,757 | A | | 12/1997 | Heverly |
| 5,704,485 | A | | 1/1998 | Cautereels et al. |
| 5,860,556 | A | * | 1/1999 | Robbins, III ..... 220/666 |

(Continued)

FOREIGN PATENT DOCUMENTS

| | | |
|---|---|---|
| CA | 329212 | 1/2010 |
| CA | 329276 | 1/2010 |
| CA | 413133 | 4/2010 |

*Primary Examiner* — Mickey Yu
*Assistant Examiner* — Niki Eloshway
(74) *Attorney, Agent, or Firm* — Lowe Graham Jones PLLC

(57) ABSTRACT

A carrier for covering and transporting baked goods or other food products includes a base for supporting a pie, cake, cupcakes, or other baked goods. A cover is configured to be attached to the base to generally enclose the carrier, thereby protecting the baked goods for transport or storage. The cover is formed with a flexible membrane that makes it collapsible for more convenient storage.

6 Claims, 4 Drawing Sheets

(56) References Cited

U.S. PATENT DOCUMENTS

| | | | | | |
|---|---|---|---|---|---|
| 5,912,033 | A | * | 6/1999 | Ferguson | 426/124 |
| D413,489 | S | | 9/1999 | Miller | |
| D418,021 | S | | 12/1999 | Terracciano et al. | |
| D422,456 | S | * | 4/2000 | Krueger | D7/610 |
| D450,580 | S | | 11/2001 | Littlejohn et al. | |
| D479,441 | S | | 9/2003 | Whitworth et al. | |
| D481,910 | S | | 11/2003 | Kim | |
| D489,254 | S | | 5/2004 | Kocis et al. | |
| D500,227 | S | | 12/2004 | Seok | |
| 6,877,629 | B2 | * | 4/2005 | Meyer | 220/212 |
| D508,378 | S | | 8/2005 | Bertulis | |
| D515,363 | S | * | 2/2006 | Driggers et al. | D7/610 |
| D527,227 | S | | 8/2006 | Bertulis | |
| D549,519 | S | | 8/2007 | Moon et al. | |
| D557,601 | S | | 12/2007 | Minidis | |
| 7,472,799 | B2 | | 1/2009 | Cadiente et al. | |
| D588,874 | S | | 3/2009 | Huang | |
| D592,049 | S | | 5/2009 | Doliwa et al. | |
| D601,860 | S | * | 10/2009 | Madagan | D7/610 |
| 7,614,518 | B2 | * | 11/2009 | Barber | 220/23.89 |
| D608,592 | S | | 1/2010 | Curtin | |
| D614,453 | S | | 4/2010 | Curtin et al. | |
| 2006/0266757 | A1 | * | 11/2006 | Camacho et al. | 220/912 |
| 2007/0007291 | A1 | * | 1/2007 | Gunn | 220/23.86 |

* cited by examiner

BAKED GOODS CARRIER

PRIORITY CLAIM

This application claims the benefit of prior U.S. application Ser. No. 61/151,802 filed Feb. 11, 2009, the contents of which are incorporated by reference.

FIELD OF THE INVENTION

This invention relates generally to containers for carrying cakes, cupcakes, pies, and other baked goods.

BACKGROUND OF THE INVENTION

It can be very useful to have a container specifically configured to hold cakes, cupcakes, pies, or other baked goods for transport from one location to another. Unfortunately, these specific-purpose containers tend to be large and bulky and therefore take up an inordinate amount of space when not in use. The present invention overcomes this problem by providing a carrying device that can be collapsed for storage when not in use.

SUMMARY OF THE INVENTION

The preferred version of the present invention includes a base for supporting a pie, cake, cupcakes, or other baked goods. A cover is configured to be attached to the base to generally enclose the carrier, thereby protecting the baked goods for transport or storage. The cover is formed with a flexible membrane that makes it collapsible for more convenient storage.

In some versions of the invention, handles are incorporated into the cover, the base, or both. In some examples, handles at the lower rim of the cover include surfaces that engage mating surfaces on the base in order to hold the cover to the base.

Depending on the size of the carrier, one or more internal plates may be provided. In some examples, the carrier includes two internal plates that are configured to be stacked one on top of the other. The upper plate preferably includes collapsible supports enabling the plate to lie substantially flat against the lower plate for storage within the carrier when the cover is collapsed.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
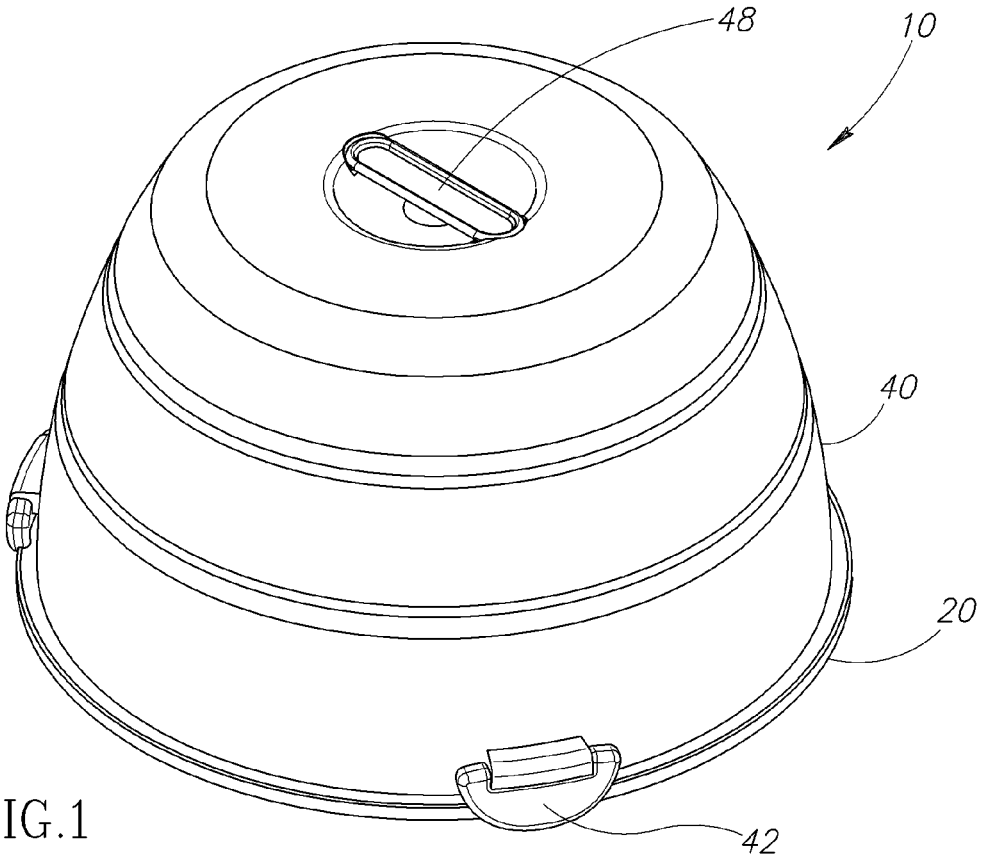
FIG. 1 is a perspective view of a baked goods carrier, shown in an expanded position.
Figure 2:
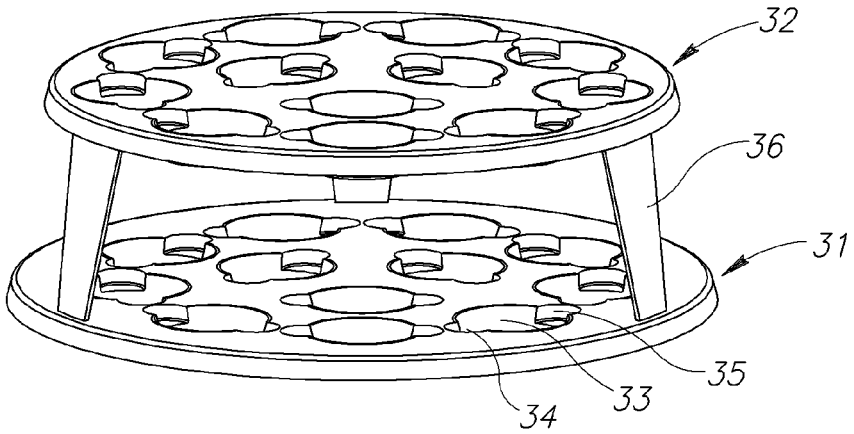
FIG. 2 is a perspective view of an upper and lower tray that are optionally included within a preferred baked goods carrier.
Figure 3:
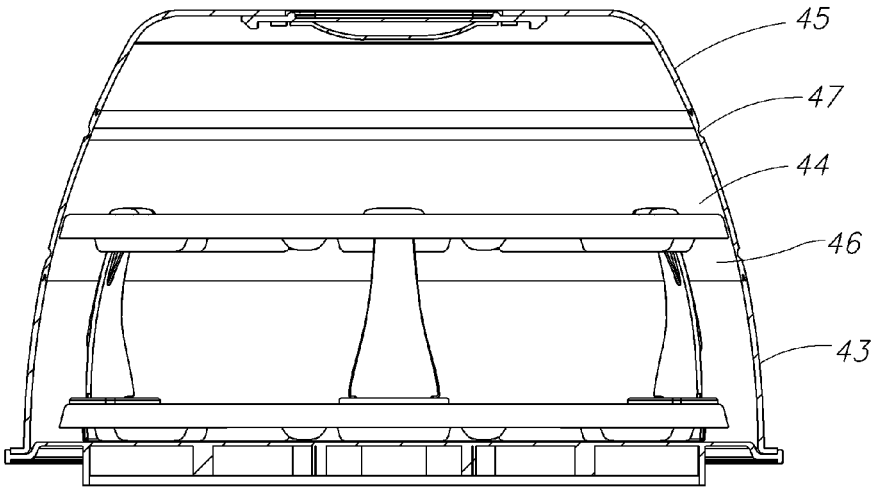
FIG. 3 is a sectional view of the preferred carrier of FIG. 1, the section being taken along a plane bisecting the upper handle longitudinally.

Several preferred versions of the baked goods carrier are shown in the illustrations and described below. It should be understood that the carrier as shown and described is ideally suited for baked goods, but that the use of the term "baked goods" is not intended to limit the scope of the invention to items that are baked. Rather, the carrier may work equally well for other transportable items, especially other food items prepared other than by baking. For the sake of simplicity, however, the description that follows will generally refer to pies, cakes, cupcakes or other baked goods.

The preferred carrier 10 generally includes a base 20, a tray (described below), and a cover 40. In some versions the base and the tray may be consolidated as a single component or, alternately stated, the carrier may have a base without an additional tray. Preferably, however, the base 20 is generally planar and can be used to support a tray 30 having features that are tailored for carrying particular food items. A preferred cupcake tray, for example, is configured differently from a preferred pie tray and in each case the tray is configured to rest on top of the base.

One or more locks 42 are provided on the cover 40. The locks are pivotally mounted on the cover and configured with an internal cavity that is shaped to receive a peripheral flange 41 integrally formed in the base. The flange may further have a detent that snaps into a groove within the lock to securely hold the lock in place. Though the preferred version includes pivotally mounted locks secured to the cover, a variety of alternate locking structures are possible. For example, the locks may be mounted to the base and pivotally engage the cover, reversing the orientation described above. Yet other sliding, snapping, or other fasteners are also possible to hold the cover to the base.

The cover is preferably formed in three sections to facilitate the ability of the cover to collapse. A lower section 43 is generally rigid and terminates in a peripheral rim that engages the base. An upper section 45 is also generally rigid and forms the top of the cover, while a central section 44 joins the upper section to the lower section. In a preferred version, both the upper section and the lower section are formed from a clear plastic, allowing a user to see the baked goods stored within the carrier. The central section is formed from a relatively more flexible material such as silicone. A pair of living hinges 46, 47 are provided within the central section in order to facilitate bending of the central section in order to collapse the cover.

Most preferably, the living hinges are provided at a location that is very closely adjacent the location where the central section joins the upper and lower sections. By forming the living hinges very close to the rigid materials, the central section can be formed from a thicker and more durable layer of material. While the thicker material will be more difficult to fold, the close proximity of the rigid material near the living hinges helps to facilitate bending at the location of the hinge.

The upper section of the tray may optionally include a handle 48. Preferably the handle is centrally located at the top of the tray. In other versions, however, the handle may be omitted or secured to other locations. For example, a pair of handles may be provided along the sides of the cover, secured to the rigid lower section.

The tray 30 may be in the form of a cupcake tray, as illustrated. Because cupcakes are relatively short, some versions of the invention may include a lower cupcake tray 31 and one or more additional upper cupcake trays 32. The cupcake trays include a plurality of cavities 33 that are configured to hold cupcakes. In general, the cavities have a substantially circular lower portion that is sized and configured to receive a standard cupcake. An upper portion of the cavity has a somewhat larger circular area and further includes a pair of opposing lobes 34, 35. The lobes provide an open space between the sidewalls of the cavity and a portion of a cupcake inserted into the cavity to allow a person to insert fingers into the cavity to remove a cupcake.

The cupcake tray may optionally include one or more legs 36 to allow additional trays to be stacked on top of a lower cupcake tray. In a preferred version, the legs have an upper axle that is pivotally secured within a receiving well formed on a bottom side of the cupcake tray. A lower portion of the leg includes a tab 38 that is configured to be received within a corresponding slot 39 formed on an upper side of the tray. As shown, three legs are provided at locations generally evenly spaced about the periphery of the cupcake tray. Any number of legs may be used, however, and the legs may alternatively be located at any location within the interior of the tray. Likewise, the legs may be configured to extend upward from a lower tray and engaging an upper tray rather than legs extending downward from an upper tray. When not in use, the legs are pivotable toward the center of the tray to a position that is substantially parallel with the plane of the tray, thereby allowing the upper tray to be stacked relatively flat on top of the lower tray.

The container is preferably designed to facilitate storage of the container in an efficient manner. The location of the living hinges and the dimensions of the trays and cover are selected for the most compact storage. In a preferred version, at least two cupcake trays 31, 32 are provided. The cupcake trays are formed so that they can nest within one another in a storage position. If the legs are pivotally secured to the upper tray, then in a stored nesting position the lower tray 31 will nest within the upper tray 32 because there are no legs to interfere with nesting.

Figure 4:
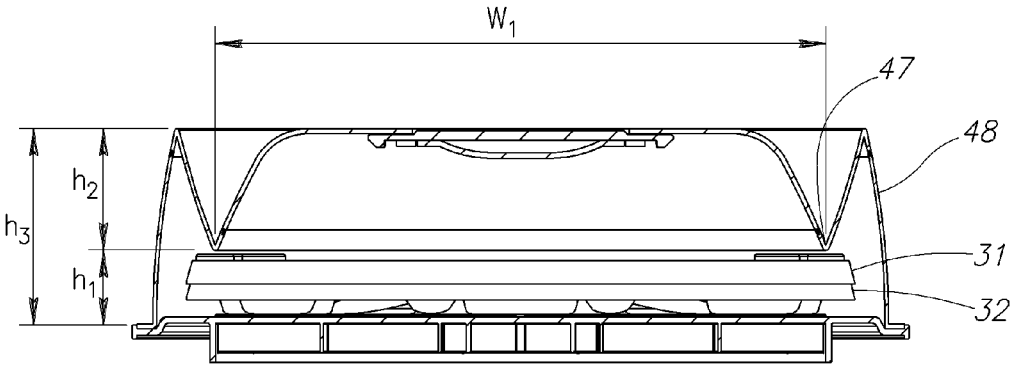
FIG. 4 is a sectional view of the preferred carrier as in FIG. 3, shown with the carrier in a collapsed position.
Figure 5:
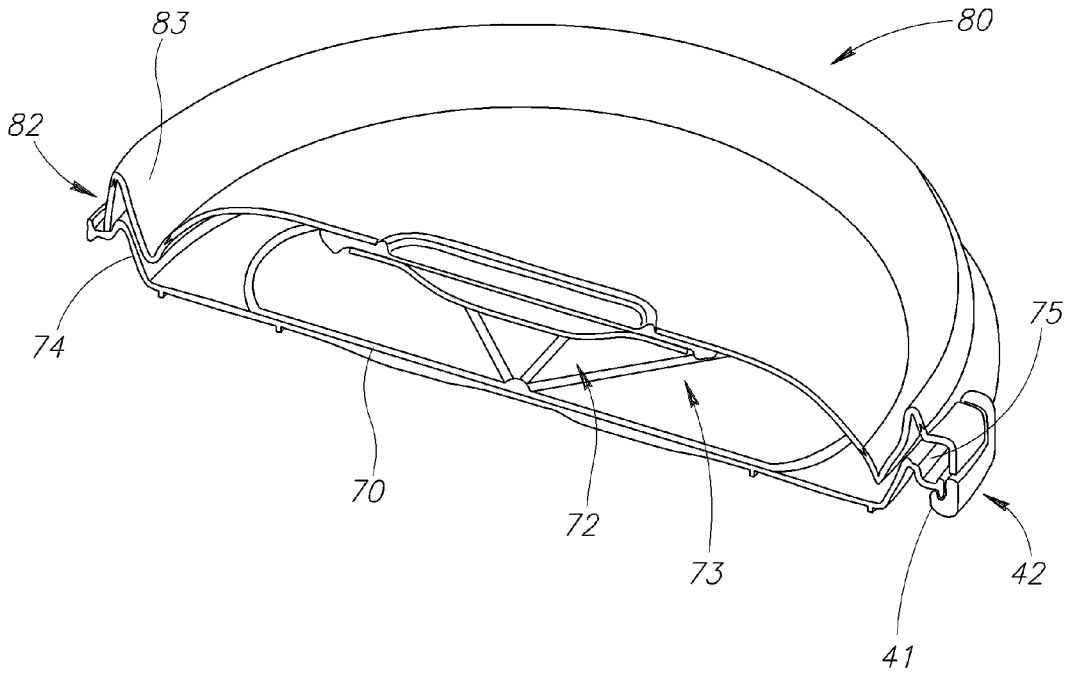
FIG. 5 is sectional view of an exemplary carrier, formed in a round shape and configured as a pie carrier.

The versions as illustrated in FIGS. 4 and 5 are configured with a height that is suitable to enclose two or more inner trays of cupcakes and the like, or a tall cake or other such item. The nested trays form a height h1 above the base, and the living hinges and the dimensions of the upper and lower sections of the cover are configured so that the cover can be collapsed and secured to the base with the nested trays inside the carrier. Preferably, this nesting collapsed configuration is created by the dimensional relationships as illustrated. The lower living hinge 48 is formed adjacent the top edge of the lower carrier section 43 such that the lower living hinge 48 has a height h3 above the rim of the carrier. In addition, the upper living hinge 47 is formed at a location such that it will fold at a location having a height greater than or equal to the height h1 of the trays, in order to provide clearance above the nested trays. In order to provide the most compact storage, the upper living hinge is approximately at the height h1 when the cover is collapsed. Accordingly, the upper living hinge must be located at a distance h2 below the top of the tray that is less than or equal to the difference between the height of the lower living hinge and the height of the nested trays.

In other versions of the invention this height relationship among the living hinges and trays may be modified, though it may result in the inclusion of more than two living hinges or a reduction in the diameter of the trays. In the preferred version as described above, only two living hinges are provided.

The tray may be configured differently for different baked goods. For example, a cake tray 60 may be used. A preferred cake tray is generally planar and fits within the perimeter of the base 20. As shown, the cake tray includes a plurality of radially extending shallow slots or markings 62 originating at the center of the tray. The slots are useful for a visual slicing guide when cutting the cake.

A pie tray may also be incorporated although, in a preferred version, the pie carrier does not have a separate tray but rather uses only the base. In the illustrated example of a pie carrier, the base 70 includes a plurality of ribs 72 forming wedge shapes 73 indicative of pieces of pie. The ribs are formed from a non-skid material such as rubber, thereby allowing a pie pan to be placed directly on the base in order to reduce the likelihood of the pie pan sliding on the base during travel.

In the illustrated pie carrier, the base includes a peripheral sidewall 74 that is preferably inclined radially outward from the center of the base. The planar bottom section of the base includes a diameter extending across the base from the corners formed at the base of the inclined sidewalls. The peripheral sidewall terminates in a generally horizontal flange 75 that is configured to receive the cover 80.

The cover is formed in three sections as discussed above, including a rigid lower section 82, a flexible central section 83, and a rigid upper section 84 forming a dome. The cover in the pie carrier generally does not need as much height as that of the cupcake carrier or cake carrier, and in the preferred version the lower section is much shorter than in the cupcake version. In this case, the upper section 84 includes a diameter that is less than the diameter of the planar bottom section of the base. In the illustrated version, the upper section has a diameter that is only slightly smaller than the diameter of the planar bottom section of the base. An upper living hinge is provided within the flexible section of the cover such that a first folding location is provided within the diameter of the planar bottom section of the base. A lower living hinge is provided within the flexible section of the cover, with the lower living hinge being adjacent the lower rigid section. Most preferably, the lower and upper living hinges are provided at locations spaced apart from one another such that in the collapsed position the central flexible section forms an inclined wall that is generally parallel to the inclined wall 74 of the base. This is generally accomplished by limiting the height of the lower rigid section of the cover so that extends only a short distance above the top of the base.

Figure 6:
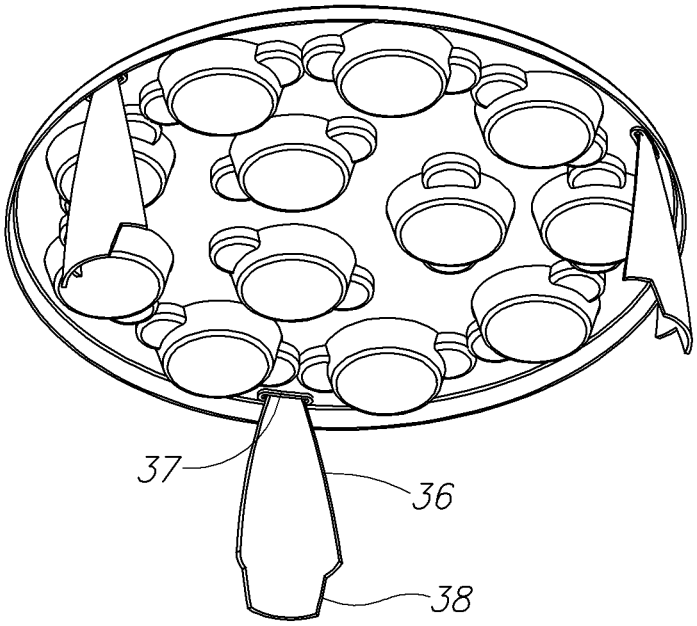
FIG. 6 is a bottom perspective view of a preferred cupcake insert tray.
Figure 7:
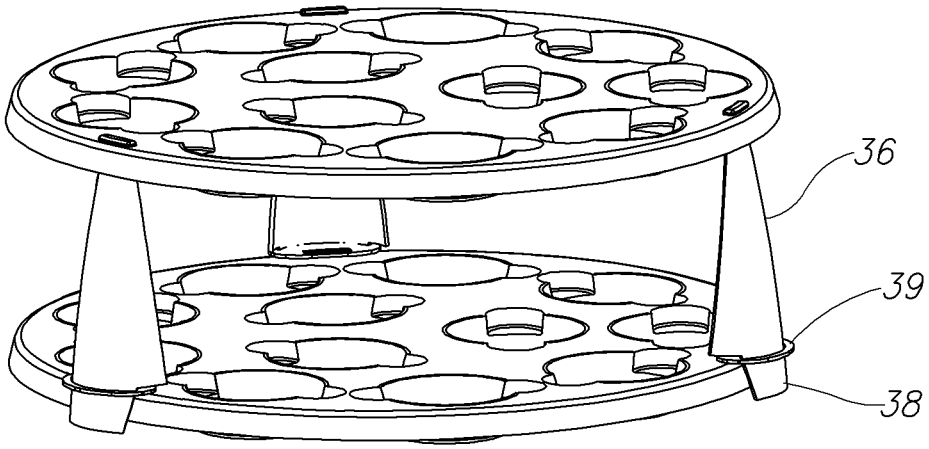
FIG. 7 is a side view of an upper tray configured as attached to a lower tray insert.

In yet other versions, the carrier may be substantially square or rectangular rather than round. Examples are shown in the perspective sectional views of FIGS. 6 and 7, showing these alternative peripheral shapes (with the missing cutaway half being a mirror image of the portion illustrated). The square or rectangular versions generally have rounded corners to best facilitate folding along the living hinges, but otherwise may be configured in the manner as described above.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A baked goods carrier, comprising:

a base for supporting one or more baked food items; and a lid removably attached to the base, the lid having an upper rigid section formed from a first material, a lower rigid section, and a flexible section formed from a second material, the second material being different from the first material, and secured between the upper rigid section and the lower rigid section, the flexible section having a first living hinge and a second living hinge, the first living hinge and the second living hinge enabling the lid to be selectively movable between a collapsed position and an expanded position while the lid is attached to the tray, the upper rigid section in the collapse position being concentrically received within a lower portion of the flexible section, the upper rigid section further having a diameter that is less than a diameter of the flexible section such that the flexible section forms a sidewall extending between the upper rigid section and the lower rigid section, the sidewall extending downwardly and outwardly from the upper rigid section to the lower rigid section, wherein the upper rigid section is received within the flexible section in the collapsed position, the lid further having a handle attached to the upper rigid section, the handle being configured to enable the lid and base together to be carried by the handle when the lid is attached to the base, wherein the upper rigid section is formed from plastic and the second material is silicone;

the lid further comprising:

a first height in the collapsed position, the first height extending from the base to the first living hinge;

a second height in the collapsed position, the second height extending from the first living hinge to the second living hinge; and a third height in the collapsed position, the third height extending from the base to a top of the lid;

wherein the sum of the first height and the second height is substantially equal to the third height; and a first removable tray sized and arranged to be supported by the base and enclosed within a space defined by the lid and the base; the first removable tray being configured with a plurality of cavities, each of the cavities being sized to receive a cupcake, the first removable tray having a vertical height that is less than the first height, and further the first removable tray being sized and configured to be fit in a space between the base and the first living hinge when the carrier is in the collapsed position.

2. The baked goods carrier of claim 1 wherein the lower rigid section is formed from clear plastic and the upper rigid section is formed from clear plastic.

3. The baked goods carrier of claim 1, further comprising a second removable tray configured to be nestable within the first removable tray, and further wherein the first removable tray and the second removable tray in a nested position are received within the space defined by the tray and the first living hinge when the carrier is in the collapsed position.

4. The baked goods carrier of claim 3, wherein the second removable tray further comprises a plurality of retractable legs, each of the legs being extendable to a deployed position wherein the second removable tray is positionable above the first removable tray.

5. The baked goods carrier of claim 4, wherein each of the plurality of retractable legs is pivotally movable between a retracted position and the deployed position, and further wherein each of the plurality of retractable legs terminates in a tab that is receivable within a corresponding slot formed in the first removable tray.

6. The baked goods carrier of claim 1, further comprising a plurality of locks formed on the lid for securing the lid to the base.

* * * * *